United States Patent [19]

MacFarlane

[11] Patent Number: 5,002,040

[45] Date of Patent: Mar. 26, 1991

[54] COMPLETE AIR PACKAGE EXHAUST UNIT

[76] Inventor: George MacFarlane, 21 Tynevale Drive, Weston, Ontario, Canada, M9R 2B3

[21] Appl. No.: 480,571

[22] Filed: Feb. 15, 1990

Related U.S. Application Data

[63] Continuation of Ser. No. 160,309, Feb. 25, 1988, abandoned.

[51] Int. Cl.[5] ..... F24C 15/20

[52] U.S. Cl. ..... 126/299 D; 126/299 E; 55/DIG. 36

[58] Field of Search ..... 126/299 D, 299 R, 299 E, 126/299 F, 287.5, 312, 300, 21 R, 21 A; 98/115.1, 115.3; 55/DIG. 36, 213, 212, 483

[56] References Cited

U.S. PATENT DOCUMENTS

| | | | |
|---|---|---|---|
| 2,794,514 | 6/1957 | Risley | 126/299 D |
| 2,868,108 | 1/1959 | Peterson | 126/299 D |
| 3,260,189 | 7/1966 | Jensen | 126/299 D |
| 3,785,124 | 1/1974 | Gaylord | 126/299 D |
| 3,954,427 | 5/1976 | Jenn | 126/299 D |
| 4,235,220 | 11/1980 | Hepner | 126/299 D |
| 4,350,504 | 9/1982 | Diachuk | 126/299 D |
| 4,352,349 | 10/1982 | Yoho | 126/299 R |
| 4,668,394 | 5/1987 | Badolato et al. | 55/484 |

*Primary Examiner*—James C. Yeung

[57] ABSTRACT

In a moveable self-contained exhaust unit for recirculating exhaust air from cooking apparatus comprising: a body having an air inlet and air outlet; a hood assembly connected to said body, said hood assembly adapted to receive cooking apparatus therebelow, and including an aperture communicating with said air inlet of said body; filter structure disposed interally of said body between said air inlet and said air outlet; a blower structure disposed interiorally of said body for drawing exhaust air from said cooking apparatus, through said aperture, air inlet, and filter structure, and recirculating said filtered air through said air outlet.

14 Claims, 7 Drawing Sheets

LEGEND

| DESIGNATION | DESCRIPTION | QUANTITY |
|---|---|---|
| 1 | MAIN DISCONNECT | 1 |
| 2 | FUSES - MOTOR | 3 |
| 3 | OVERLOAD RELAY | 1 |
| 4 | MOTOR - FAN | 1 |
| 5 | FUSES - TRANSFORMER | 2 |
| 6 | CIRCUIT BREAKERS - OUTLETS | 3 |
| 7 | ELECTRICAL OUTLETS | 3 |
| 8 | TRANSFORMER | 1 |
| 9 | PUSH BUTTON - OFF (RED) | 1 |
| 10 | PUSH BUTTON - ON (GREEN) | 1 |
| 11 | FIRE PROTECTION SWITCH | 1 |
| 12 | CONTACTOR - MOTOR (3P-12A, 1P-12B) | 1 |
| 13 | LAMP-GREEN (UNIT ON) | 1 |
| 14 | CONTACTOR - OUTLET (3P-14A) | 1 |
| 15 | CONTACTOR - OUTLET (3P-15A) | 1 |
| 16 | CONTACTOR - OUTLET (3P-16A) | 1 |
| 17 | LAMP - RED (FIRE PROTECTION OFF) | 1 |
| 18 | PRESSURE SWITCH (FILTER #1) | 1 |
| 19 | AR1 RELAY (ALARM RELAY 1) (1P-19A) | 1 |
| 20 | LAMP-RED (FILTER #1) | 1 |
| 21 | PRESSURE SWITCH (FILTER #2) | 1 |
| 22 | AR2 RELAY (ALARM RELAY 2) (1P-22A) | 1 |
| 23 | LAMP-RED (FILTER #3) | 1 |
| 24 | PRESSURE SWITCH (FILTER #3) | 1 |
| 25 | AR3 RELAY (ALARM RELAY 3) (1P-25A) | 1 |
| 26 | LAMP - RED (FILTER # 3) | 1 |
| 27 | FIRE THERMOSTAT | 1 |
| 28 | CR2 RELAY (ALARM RELAY OVERALL) (2P-28A, 28B) | 1 |
| 29 | PRESSURE SWITCH (FILTERS OVERALL) | 1 |
| 30 | TIME DELAY (1) | 1 |
| 31 | CR3 RELAY (ALARM RELAY OVERALL) (1P-31A) | 1 |
| 32 | LAMP-RED (FILTERS OVERALL) | 1 |
| 33 | PUSH BUTTON-SILENCE ALARM (YELLOW) | 1 |
| 34 | CR1 RELAY (CONTROL RELAY) (2P-34A, 34B) | 1 |
| 35 | BUZZER | 1 |
| TB | TERMINAL BLOCK | 12 |

NOTE: (X) - CONNECTION POINT FOR ECCOLO UNIT (Y) - ELECTRICAL SERVICE CONNECTION

FIG. 11

COMPLETE AIR PACKAGE EXHAUST UNIT

This is a continuation of application Ser. No. 07/160,309, filed Feb. 25, 1988, abandoned.

FIELD OF INVENTION

This invention relates to a moveable, self-contained exhaust unit for recirculating exhaust air from electrical cooking apparatus, and particularly relates to an exhaust unit which obviates the need of separate ductwork.

BACKGROUND TO THE INVENTION

Various apparatus for ventilating or exhaust fumes from a stove have heretofore been devised.

For example, U.S. Pat. No. 4,350,504 discloses a cooking unit having a hood equipped with air cleaning structure and blowers for moving air through the cleaning structures, and in particular clean air is discharged laterally off the hood into the environment surrounding the cooking equipment through various outlets.

Furthermore, U.S. Pat. No. 4,047,519 discloses an exhaust hood apparatus which is adapted to be installed in the area above a stove or grille in a kitchen.

Moreover, U.S. Pat. No. 4,043,320 relates to a hood assembly for removing grease from vapours generated by griddles and other types of range units.

U.S. Pat. No. 3,303,839 relates to a ventilated cook stove unit which is adapted to be moved from place to place.

Finally U.S. Pat. No 3,334,621 teaches a cooking appliance having a horizontal air discharge duct positioned between the cooking platform and a base support assembly. Air discharging from the duct is directed in a horizontal path by a grille disposed in the exhaust end of the duct. A pair of air deflectors co-operate with the grille and each deflector has a plurality of vertical vanes interposed between the grille and duct.

Each of the prior art devices referred to above present relatively complicated structure having limited use as the ventilation system may either be constructed as a part of the cooking apparatus and therefore may only be used with such cooking apparatus or else are adapted to be connected to air ducts or the like in order to properly ventilate the exhaust air.

It is an object of this invention to provide a ventilation system which is adapted to receive and vent the exhaust air from a variety of electrical cooking units and which obviates the need of air ducts.

SUMMARY OF THE INVENTION

The broadest aspect of this invention relates to a moveable self-contained exhaust unit for filtering exhaust air from cooking apparatus comprising: a housing having a passage defined by a first chamber and a second chamber communicating with said first chamber said first chamber disposed laterally adjacent said second chamber; an air inlet communicating with said first chamber; an air outlet communicating with said second chamber; a hood assembly having a top wall presenting two ends and two side walls depending from the ends of said top wall, said top and side walls connected to said housing so as to define an enclosure having an opening for removably receiving said cooking apparatus within said enclosure, said hood assembly including aperture communicating with said air inlet of said housing, removably filter disposed interiorally of said housing in said first chamber; blower associated with said passage for drawing said exhaust air from said cooking apparatus through said aperture, said air inlet into said first chamber and through said filter to filter said exhaust air and for exhausting said filtered air through said second chamber and said air outlet to the exterior of said unit.

Another aspect of this invention relates to a moveable self-contained exhaust unit for filtering exhaust air from cooking apparatus and discharging filtered exhaust air exteriorally of said unit comprising: a generally rectangular housing having a passage defined by a first chamber and a second chamber communicating with said first chamber aid first chamber disposed laterally adjacent said second chamber; an air inlet communicating with said first chamber; an air outlet communicating with said second chamber; a hood assembly having a top wall presenting two ends and two spaced side walls depending from the ends of said top wall, said top and side walls connected to said housing so as to define an enclosure having an opening thereto for removably receiving said cooking apparatus within said enclosure, said housing including aperture communicating with said air inlet of said housing; grease filter disposed over said aperture of said hood; removable air filter located within said first chamber of said air passage; odor control associated with said first chamber of said air passage for controlling the odor of air filtered through said air filtering; blower associated with said passage for drawing exhaust air from said electrical cooking apparatus through said aperture, said air inlet, said filter in said first chamber to filter said exhaust air and to discharge said filtered exhaust air through said second chamber and said air outlet to the exterior of said unit.

Yet another aspect of this invention relates to a moveable self-contained exhaust unit for drawing exhaust air from cooking apparatus into said unit and discharging filtered exhaust air exteriorally of said unit comprising: a generally rectangular housing having an upper wall, lower wall, front wall, back wall, and two side walls; a passage defined by a first chamber and a second chamber communicating with said first chamber; an air inlet communicating with said first chamber; an air outlet located in said upper wall and communicating with said second chamber; a hood assembly having a top wall and two side walls depending from said ends of said top wall, said top and side walls connected to said upper and side walls of said housing so as to define an enclosure having an opening for removably receiving said cooking apparatus within said enclosure, said hood assembly including aperture communicating with said air inlet of said housing; filter disposed interiorally of said housing in said first chamber; blower disposed interiorally of said housing and located at said lower wall for drawing said exhaust air from said cooking apparatus through said aperture, said air inlet and through said first chamber and said filter to filter said exhaust air and discharge said filtered exhaust air through said second chamber to said air outlet to the exterior of said unit.

DRAWINGS

These and other objects and features shall now be described in relation to the following drawings:

FIGS. 10 and 11 are wiring diagrams of the exhaust unit,.

DESCRIPTION OF THE INVENTION

Like parts will be given identical numbers throughout the figures.

The exhaust unit is generally depicted by numeral 10 and comprises a body 12 and a hood assembly 14 which is connected to the body 12.

Figure 1:
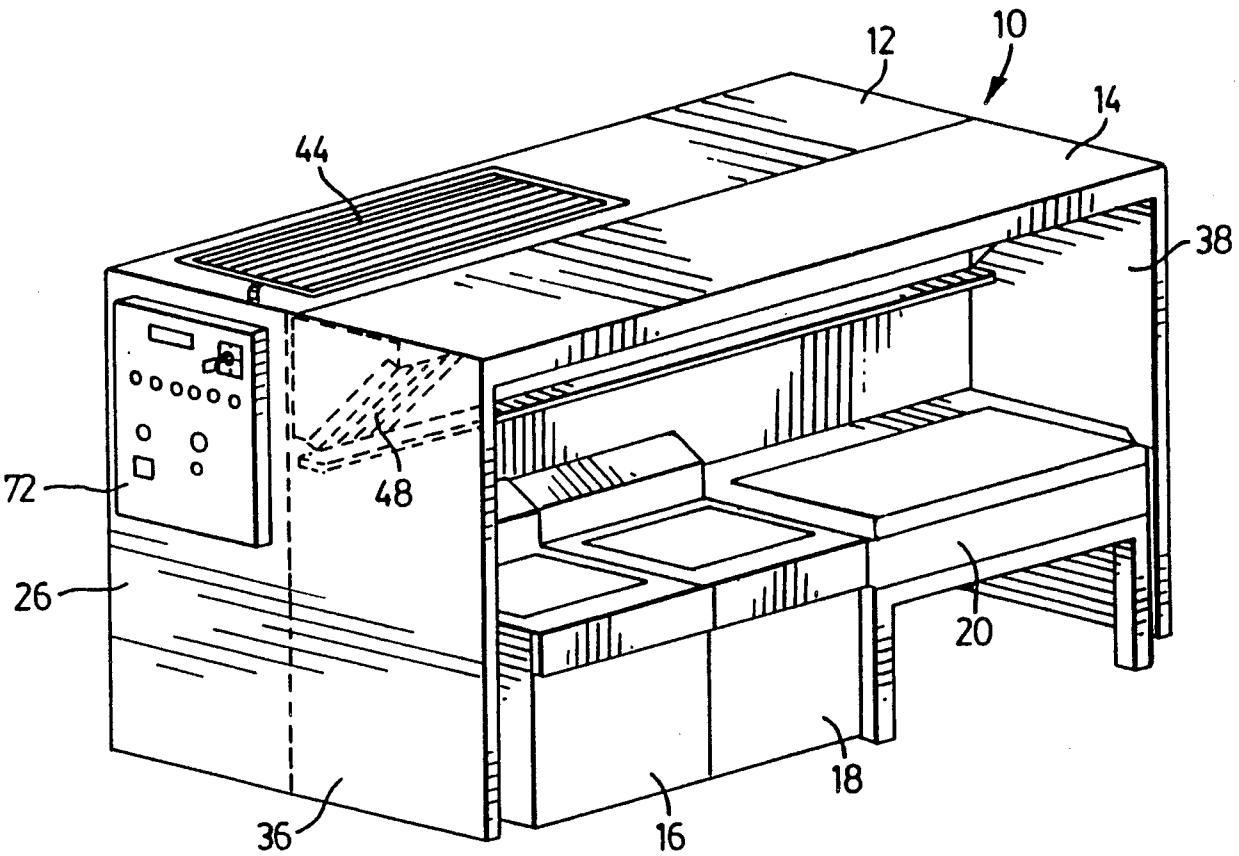
FIG. 1 is a front perspective view of said moveable self-contained exhaust unit.

The exhaust unit 10 is adapted to receive electrical cooking equipment within the confines of the hood 14. Although two electrical fryers 16 and 18, and one electrical griddle 20 is disclosed in FIG. 1, other arrangements of electrical Cooking apparatus may be accommodated by the exhaust unit 10.

The exhaust unit 10 illustrated herein is moveable to any location and is particularly well adapted for servicing fast food outlets in shopping centres or the like where electrical cooking appliances are utilized, as the exhaust unit 10 depicted herein is a self-contained unit obviating the need to be connected to expensive ductwork. The exhaust unit 10 is moveable by providing removable castors at the bottom of the unit. Once the unit 10 is moveable along the castors to the devised location the castors may then be removed so as to fixedly locate the unit 10 in the devised location due to the weight of the unit 10.

More particularly, the exhaust unit 10 disclosed herein recirculates or vents clean air into the environment surrounding the exhaust unit 10 thereby making it unnecessary to instal expensive ductwork to vent the cleaned air outside of the shopping mall or the like.

The body 12 comprised spaced top and bottom walls 22 and 24 respectively joined to sidewalls 26 and 28 and front and back walls 30 and 32 respectively.

The body 12 and in particular walls 22, 24, 26, 28, 30 and 32 are manufactured from stainless steel 18 gauge cold rolled steel.

The hood assembly 14 includes a top portion 34 which is connected to the top wall 22 of body 12 so as to define a common plane.

The hood assembly 14 also includes side portions 36 and 38 which are jointed to the sidewalls 26 and 28 of body 12 so as to define common planes respectively. The hood assembly 14 and particularly the portions 34, 36 and 38 are manufactured from stainless steel 18 gauge cold rolled steel.

Figure 3:
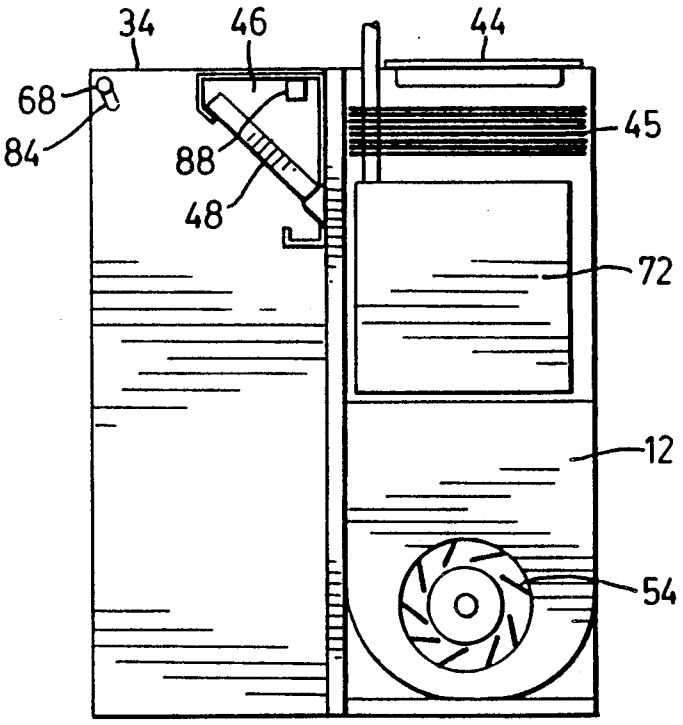
FIG. 3 is a side elevational view of said movable self-contained exhaust unit taken along the lines 3—3 of FIG. 2.
Figure 2:
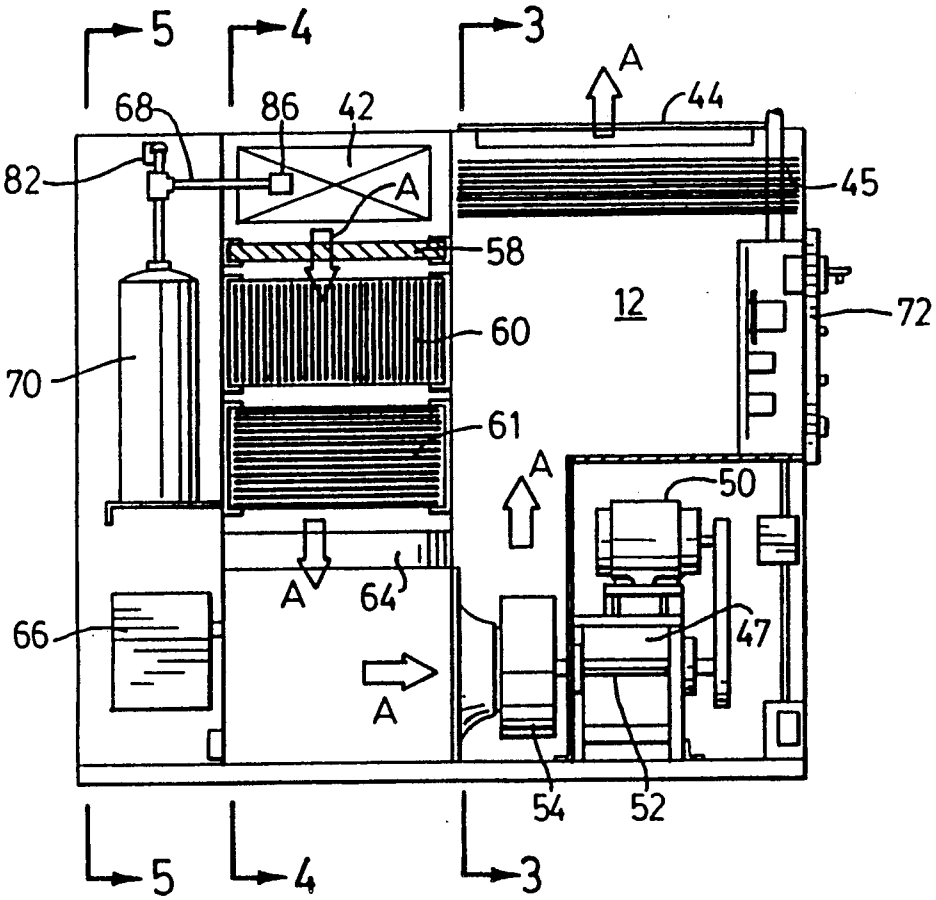
FIG. 2 is a rear elevational view of said moveable self-contained exhaust unit.
Figure 5:
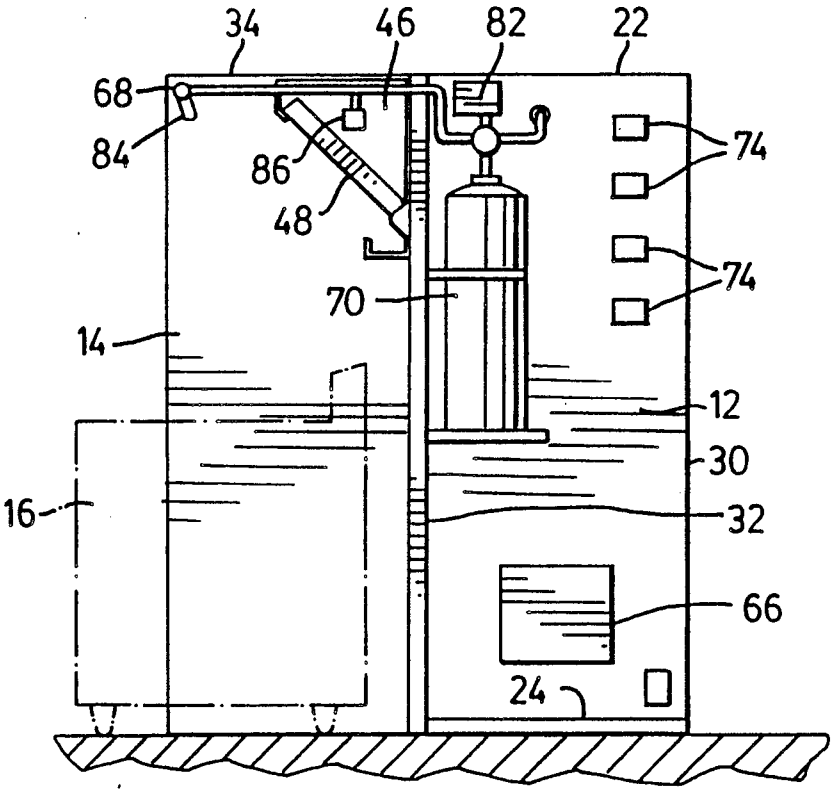
FIG. 5 is a side elevational view of said moveable self-place exhaust unit taken along the lines 5—5 of FIG. 2.
Figure 4:
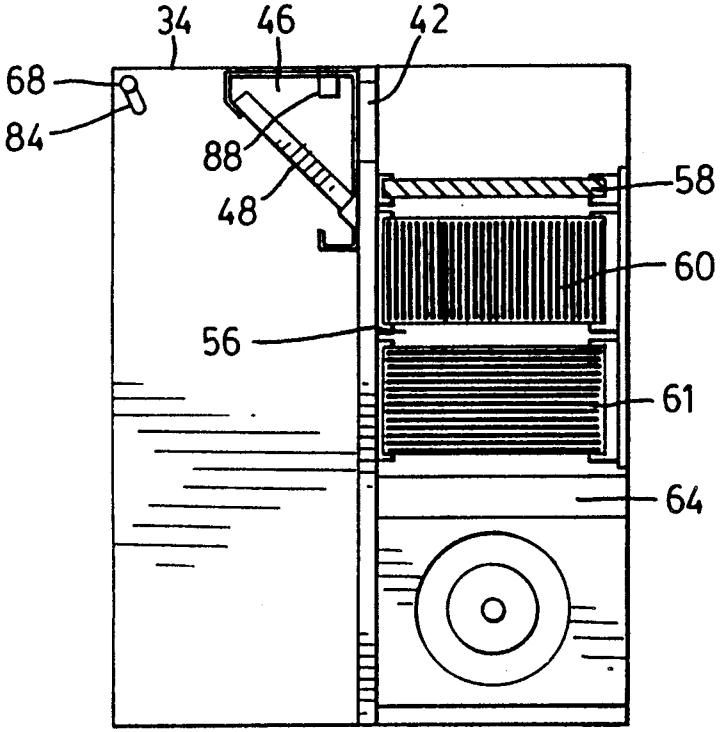
FIG. 4 is a side elevational view of said movable self-contained exhaust unit taken along the lines 4—4 of FIG. 2.

The interior of the body 12 is best illustrated in FIGS. 2, 3 and 4. The body or housing 12 includes an air passageway 40 defined by a first chamber 33 and a second chamber 35 communicating with the first chamber. MOre particularly, the first chamber is best illustrated in FIG. 2 and comprises the region whereby the Arrows A point downwardly while the second chamber comprises of the region best described by the Arrows A point upwardly. The air inlet 42 communicates with the first chamber of passageway 40 and the air outlet communicates with the second chamber of passageway 40.

The hood assembly 14 includes an aperture 46 which communicates with air inlet 42 of body 12. The hood assembly 14 also includes grease filter 48 which is disposed over aperture 46 and is adapted to remove grease and other large particles which are carried away by the exhaust air from the cooking surface of cooking appliances 16, 18 and 20.

A blower assembly generally depicted by numeral 47 is located internally of body 12 and is adapted to draw exhaust air from the cooking surface through grease filter 48, through aperture 46, through air inlet 42, through passage 40, and out air outlet 44.

The blower assembly 47 comprises a motor 50, fan shaft and bearing 52 and fan wheel 54

The body 12 also includes filter assembly material generally depicted by 56 for filtering exhaust air drawn through the passage 40 by blower 47. The filter material 56 may comprise of a variety of materials well known to those persons skilled in the art.

More particularly filter assembly 56 contains three stages namely, a pre-filter 58 which is 30% A.S.H.-R.A.E. rated, a medium filter 60 which is 90% A.S.H.-R.A.E. rated, and an absolute filter 61 which is 99% A.S.H.R.A.E. rated.

A filter fire damper 64 is installed in the passageway 40 upstream of the blower assembly 47 and contains a 286° fahrenheit fusible link. In other words, once the temperature of the air and passageway 40 reaches 286° fahrenheit, the fusible link is adapted to melt, thereby shutting off the passageway 40 so that blower assembly 47 does not blow or distribute air through air outlet 44 for safety reasons.

The unit 10 also includes an ecology controlled unit 66 or an odour control unit which is adapted to spray chemicals into the filtered air in a manner well known to those persons skilled in the art in order to control the odour of the filtered air circulated through the air outlet 44.

Figure 9:
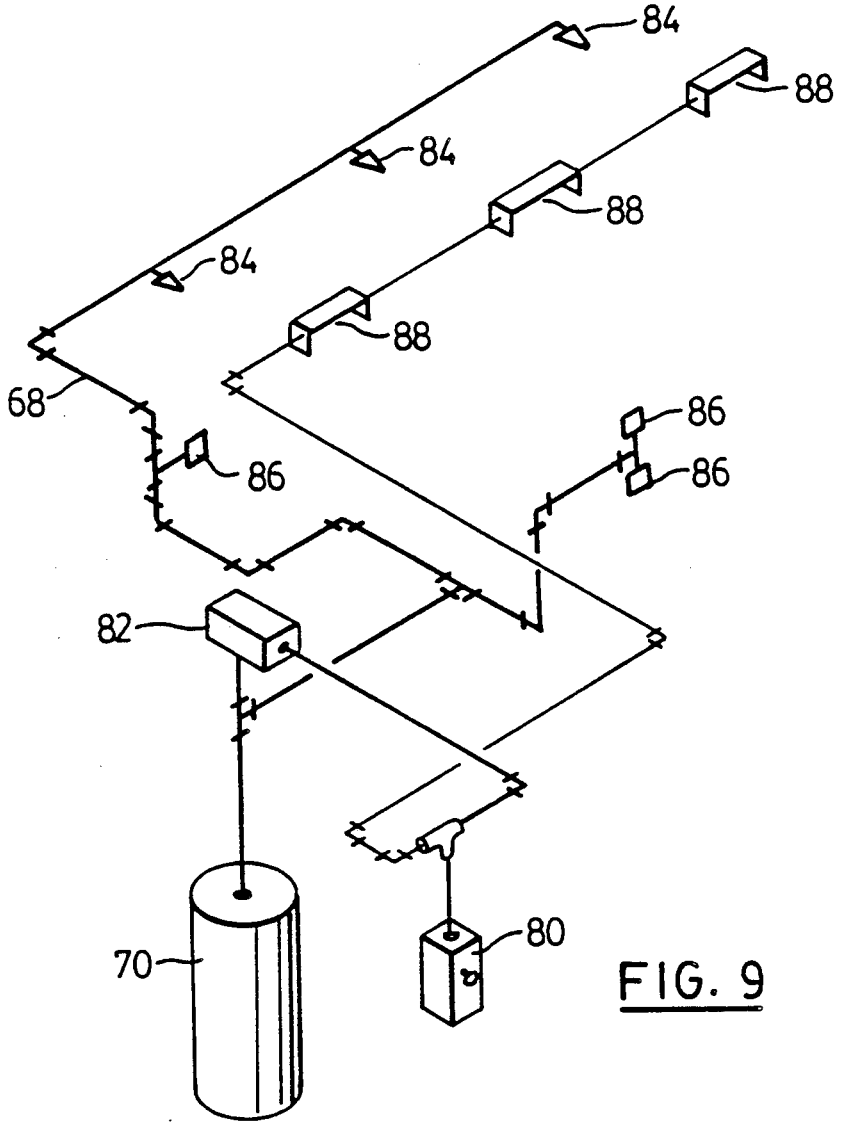
FIG. 9 is a view of the fire protection system.

Furthermore, the hood 14 includes a series of fire suppression liquid distribution and detection line 68 which are connected to a fire suppression tank 70 located within body 12. In particular the fire suppression tank 70 includes a wet chemical which is adapted to flow through the line 68 in the event of a fire in the vicinity of the cooking apparatus 16, 18 or 20, aperture 46 and air passage 40. FIG. 9 more fully illustrates the fire protection system which includes plenum nozzles 86 which are adapted to spray a wet chemical within the confines of the hood 14, and appliance nozzles 84 which are adapted to spray wet chemical onto the appliances 16, 18 and 20. Heat detectors 88 are provided which are adapted to provide a signal to the fire switch control box 82 in the event of sensing an elevated temperature. The control box 82 then activates tank 70 to spray wet chemical as described above. A pull station 80 is also provided to manually activate tank 70.

The unit 10 also includes a central panel which includes a series of electrical controlled units for controlling the operation of the unit 10. In particular, the control panel includes circuitry to turn the blower assembly 47 on and off and is electrically wired to a series of limit switches 74, one for each filter 58, 60 and 61, which switches are adapted to monitor the air resistance across each said filter so as to activate an alarm and pilot light when the resistant reaches a predetermined setting.

Such pressure switches 74 are also adapted to detect a drop in air resistance in the event that a filter 58, 60, or 61 is removed and not replaced; in which event the pressure switch 74 will stop the blower assembly 47 and activate the alarm and pilot light (not shown).

The main control panel 72 also includes a main disconnect, fuse block, motor starter and thermal overload, pilot lights, alarm, transformer and on/off push buttons. Such control panel 72 is wired so that if any control is activated to stop the blower assembly 47 the power supply to the cooking appliances 16, 18 or 20 will be turned off. The control panel 72 will be wired to a firestat adapted to stop the blower assembly 47 at 350° fahrenheit air temperature.

Figure 7:
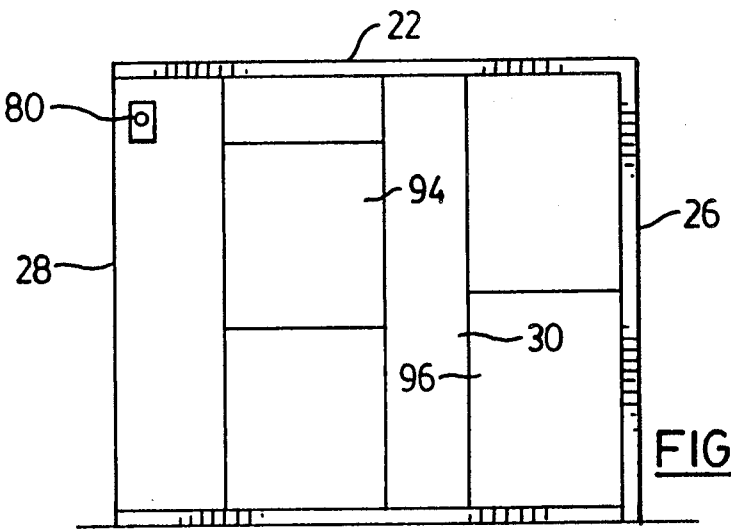
FIG. 7 is a rear elevational view of said exhaust unit.

FIG. 7 illustrates access door 94 which provides an access to the filter assembly 56 for removing and changing same; as well as an access door 96 for entry into the motor 50. An acoustic noise silencer 45 is also provided.

Figure 8:
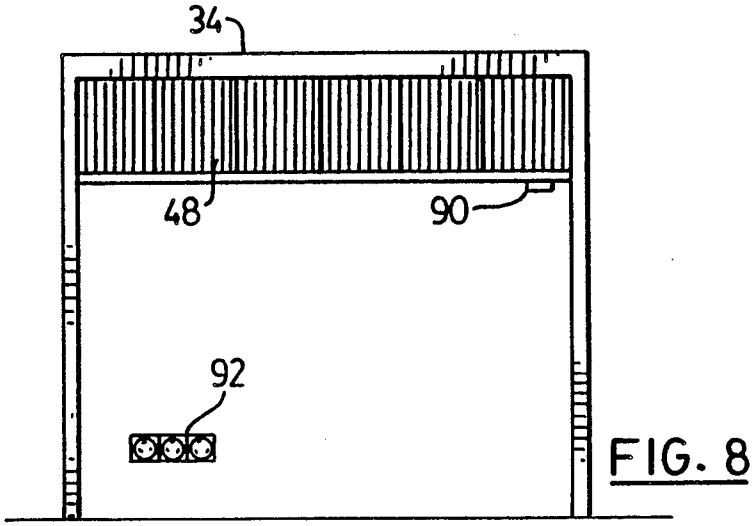
FIG. 8 is a front elevational view of said exhaust unit.

FIG. 8 illustrates the provision of a grease cup 90 for collecting grease running off the grease filters 48. Appliance receptacles 92 are also provided for providing electrical power to the appliances 16, 18 and 20. An appliance contactor 51 and appliance circuit breaker 53 is also included as illustrated in FIG. 3.

In summary the operation of the unit 10 is adapted to clean kitchen exhaust air, remove grease, smoke and other contaminants, and the clean air is adapted to be recirculated into the building where there is a higher rate of air change required for ventilation.

It is applicant's understanding that the minimum fresh air supply in shopping centre malls is in the vicinity of 0.15 cubic feet per minute (C.F.M.) per square foot of floor area and an average total air supply of 1.25 C.F.M. per square foot.

The following is an example of the minimum floor space required to operate the unit 10 for a unit 6 feet long which is adapted to operate at 300 C.F.M. per foot. Accordingly, the air flow through the unit would equal $6 \times 300$ or 1,800 C.F.M. exhaust air.

If we allow for 2 minute air changes which require 1,800 divided by 2 or 900 C.F.M. minimum of fresh outside air. Therefore the floor area required at 0.15 C.F.M. of outside air per square foot would equal 900 divided by 0.15 or 6,000 square feet of area.

It should also be noted that the average temperature for a mall supply air unit is in the vicinity of 55° fahrenheit. As the outside air temperature decreases the percentage of outside air required also decreases. For example, if we assume the following:

(a) 80° fahrenheit return air temperature for mall air conditioning system;
(b) 55° fahrenheit supply air temperature for mall air conditioning system; and
(c) 30° fahrenheit outside air temperature which is the average winter outside temperature the following calculation may be made:

*(50% mall return air @ 80°)+(50% fresh air @ 30°) divided by 100%=55° fahrenheit*

This indicates that at 30° fahrenheit outside air temperature the total supply air would be made up of 50% fresh air.

By using the 6,000 square foot figure referred to earlier and 1.25 C.F.M. per square foot, the total air would be $6{,}000 \times 1.25$ or 7,500 C.F.M.

Therefore with a 30° fahrenheit outside temperature the fresh air required would be 50% of 7,500 or 3,750 C.F.M. This would give an air change for the clean exhaust air of 3,750 divided by 1,800 or 0.48 minutes.

Figure 6:
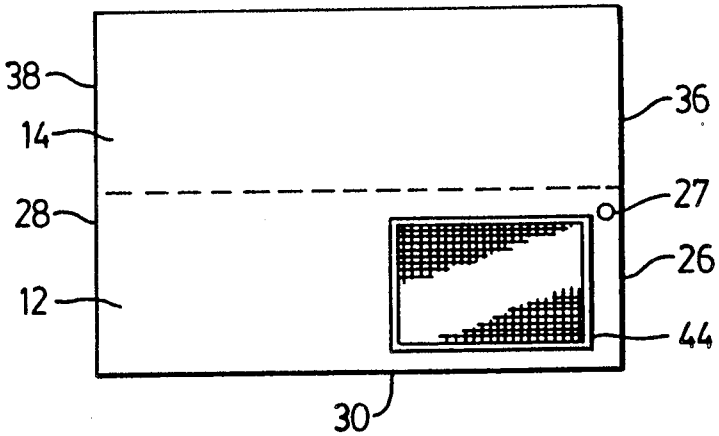
FIG. 6 is a top plan view of said unit.
Figure 10:
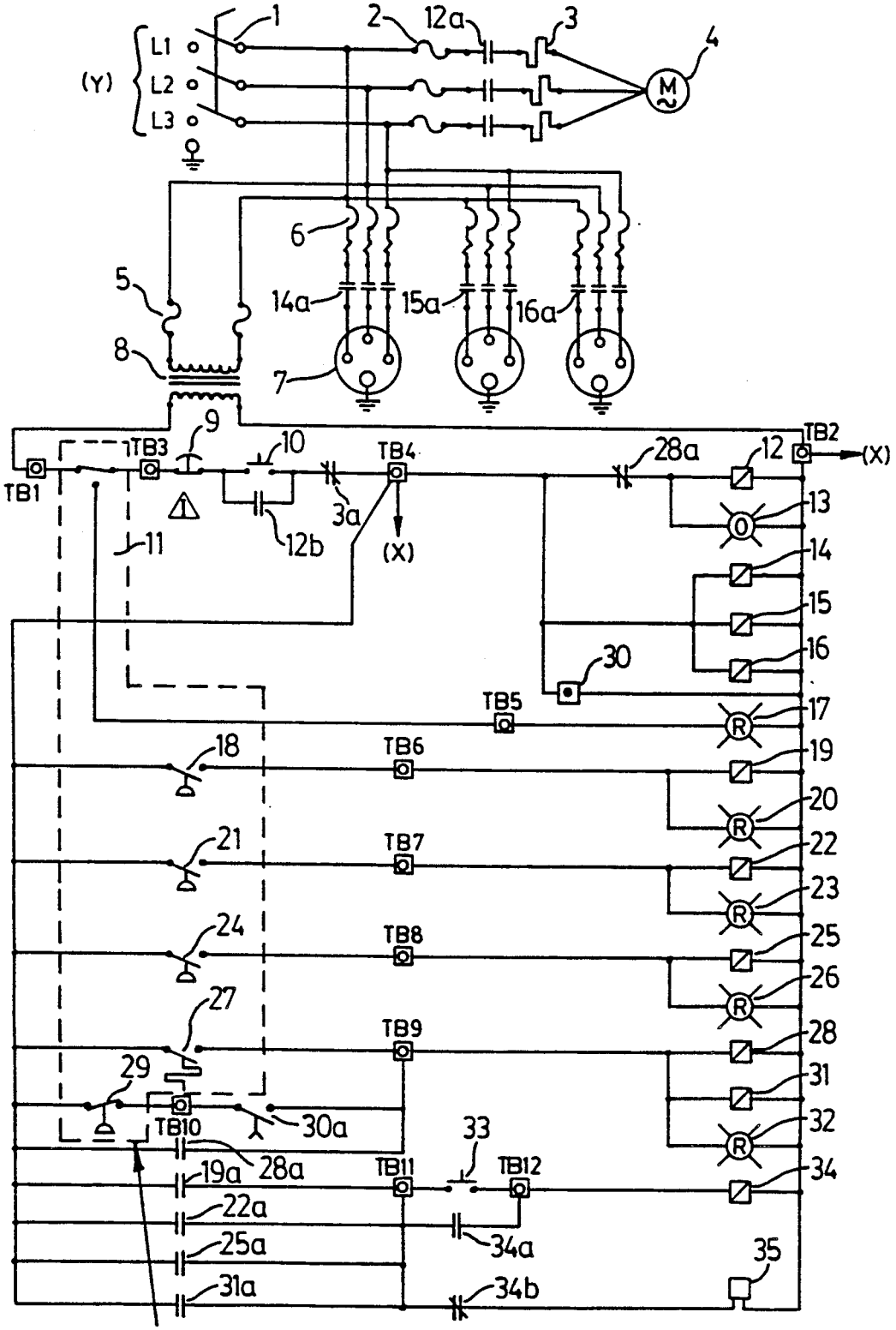

FIGS. 10 and 11 show the wiring diagrams of the exhaust unit. The top of the unit 10 is provided with an aperture 27 as illustrated in FIG. 6 for receiving the electrical wires.

Although the preferred embodiment as well as the operation and use have been specifically described in relation to the drawings, it should be understood that variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. In a moveable self-contained exhaust unit for filtering exhaust air from cooking apparatus comprising:

(a) a housing having:
  (i) a passageway defined by a first chamber and a second chamber communicating with said first chamber said first chamber disposed laterally adjacent said second chamber;
  (ii) an air inlet communicating with said first chamber;
  (iii) an air outlet communicating with said second chamber;
(b) a hood assembly having a top wall presenting two ends and two side walls depending from said ends of said top wall, said top and side walls connected to said housing so as to define an enclosure having an opening for removably receiving said cooking apparatus within said enclosure, said hood assembly including aperture means communicating with said air inlet of said housing;
(c) removable filter means disposed interiorally of said housing in said first chamber;
(d) blower means disposed internally with one of said chambers and associated with said passage for drawing said exhaust air from said cooking apparatus through said aperture, said air inlet into said first chamber and through said filter means to filter said exhaust air and for exhausting said filtered air through said second chamber and said air outlet to the exterior of said unit.

2. In an exhaust unit as claimed in claim 1 wherein said hood includes a grease filter disposed over said aperture of said hood.

3. In an exhaust unit as claimed in claim 2 including odor control means disposed interiorally of said housing, and associated with said first chamber for controlling the odor of said exhaust air drawn through said unit.

4. In a moveable self-contained exhaust unit as claimed in claim 3 adapted to exhaust air from electrical cooking apparatus.

5. In an exhaust unit as claimed in claim 4 wherein said housing includes fire damper means associated with said blower means for preventing said exhaust air from being drawn through said unit when said filtered air reaches a preselected temperature.

6. In an exhaust unit as claimed in claim 5 including control means for controlling said filtered exhaust air drawn through said air inlet and discharged through said air outlet.

7. In an exhaust unit as claimed in claim 6 wherein said control means includes means to monitor the air resistance across said filtered means and shut down said blower means and activate an alarm signal when said resistance reaches a predetermined limit.

8. In an exhaust unit as claimed in claim 7 wherein said monitoring means is adapted to activate said alarm signal when said air resistance reaches a predetermined upper limit.

9. In an exhaust unit as claimed in claim 8 wherein said filter means includes three filters adapted to incremently filter said air in three stages.

10. In an exhaust unit as claimed in claim 9 wherein said control means includes means to detect the absence of one of said three filters and stop said blower means.

11. In an exhaust unit as claimed in claim 10 wherein said means to detect the absence of one of said filters comprises pressure switch means monitoring a drop in air resistance across said filters.

12. In a moveable self-contained exhaust unit for filtering exhaust air from cooking apparatus and discharging filtered exhaust air exteriorally of said unit comprising:

(a) a generally rectangular housing having:
  (i) a passage defined by a first chamber and a second chamber communicating with said first chamber said first chamber disposed laterally adjacent said second chamber;
  (ii) an air inlet communicating with said first chamber;
  (iii) an air outlet communicating with said second chamber;

(b) a hood assembly having a top wall presenting two ends and two spaced side walls depending from said ends of said top wall, said top and side walls connected to said housing so as to define an enclosure having an opening thereto for removably receiving said cooking apparatus within said enclosure, said housing including aperture means communicating with said air inlet of said housing;

(c) grease filter means disposed over said aperture of said hood;

(d) removable air filter means located within said first chamber of said air passage;

(e) odor control means associated with said first chamber of said air passage for controlling the odor of air filtered through said air filtering means;

(f) blower means disposed internally of said second chamber and associated with said passage for drawing exhaust air from said electrical cooking apparatus through said aperture, said air inlet, said filter means in said first chamber to filter said exhaust air and to discharge said filtered exhaust air through said second chamber and said air outlet to the exterior of said unit.

13. In a moveable self-contained exhaust unit as claimed in claim 12 wherein said hood assembly includes fire suppression means for suppressing fires from said cooking apparatus.

14. In a moveable self-contained exhaust unit for drawing exhaust air from cooking apparatus into said unit and discharging filtered exhaust air exteriorally of said unit comprising:

(a) a generally rectangular housing having:
  (i) an upper wall, lower wall, front wall, back wall, and two side walls;
  (ii) a passage defined by a first chamber and a second chamber communicating with said first chamber, said first chamber disposed laterally adjacent said second chamber;
  (iii) an air inlet communicating with said first chamber;
  (iv) an air outlet located in said upper wall and communicating with said second chamber;

(b) a hood assembly having a top wall presenting two ends and two side walls depending from said ends of said top wall, said top and side walls connected to said upper and side walls of said housing so as to define an enclosure having an opening for removably receiving said cooking apparatus within said enclosure, said hood assembly including aperture means communicating with said air inlet of said housing;

(c) filter means disposed interiorally of said housing in said first chamber;

(d) blower means disposed interiorally of said second chamber of said housing and located at said lower wall for drawing said exhaust air from said cooking apparatus through said aperture, said air inlet and through said first chamber and said filter means to filter said exhaust air and discharge said filtered exhaust air through said second chamber to said air outlet to the exterior of said unit.

* * * * *